US006109055A

United States Patent [19]

Kato et al.

[11] Patent Number: 6,109,055

[45] Date of Patent: Aug. 29, 2000

[54] DOWN-FLOW-TYPE ICE-MAKING MACHINE

[75] Inventors: Sonoo Kato; Hatsuo Yamada; Tadasi Sakai; Yoshio Furukawa, all of Aichi-ken, Japan

[73] Assignee: Hoshizaki Denki Kabushiki Kaisha, Aichi-ken, Japan

[21] Appl. No.: 09/175,732

[22] Filed: Oct. 20, 1998

[30] Foreign Application Priority Data

Oct. 21, 1997 [JP] Japan ..... 9-288592

[51] Int. Cl.[7] ..... F25C 1/12

[52] U.S. Cl. ..... 62/347; 62/348

[58] Field of Search ..... 62/347, 348, 352

[56] References Cited

U.S. PATENT DOCUMENTS

| | | | |
|---|---|---|---|
| 2,682,155 | 6/1954 | Ayres et al. | 62/348 |
| 2,784,563 | 3/1957 | Baker | 62/347 |
| 2,959,026 | 11/1960 | Swanson | 62/348 |
| 3,559,424 | 2/1971 | Nelson | 62/347 |
| 3,686,890 | 8/1972 | Lyman | 62/348 |
| 3,999,401 | 12/1976 | Maust | 62/347 |
| 4,255,942 | 3/1981 | Lanzani | 62/347 |
| 5,345,782 | 9/1994 | Takahashi et al. | 62/347 |

*Primary Examiner*—William E. Tapolcai

*Attorney, Agent, or Firm*—Wenderoth, Lind & Ponack, L.L.P.

[57] ABSTRACT

A down-flow-type ice-making machine has an easily detachable pump and a level sensor mounted in a water reservoir, which allows for easy maintenance. The water reservoir is provided under a horizontal wall of a rear wall of an insulated box. A through-hole is provided in the horizontal wall. The pump and the level sensor are passed through the through-hole and fixed at a predetermined position in the water reservoir using a single bracket. The bracket is detachably mounted on the horizontal wall from the upper exterior of the horizontal wall, that is, from the exterior of the insulated box, so that the pump and the level sensor are easily detached during maintenance.

5 Claims, 4 Drawing Sheets

DOWN-FLOW-TYPE ICE-MAKING MACHINE

BACKGROUND OF THE INVENTION

1. Field of the Invention

The present invention relates to a down-flow-type ice-making machine wherein a water reservoir is arranged below an ice-making unit and wherein a pump and a level sensor are arranged in the water reservoir, and in particular, which relates to the manner in which the pump and the level sensor are mounted.

2. Description of the Related Art

With regard to a conventional down-flow-type ice-making machine, an ice-making unit and a water reservoir are housed in an insulated box made of an insulating material. A pump and a level sensor mounted in the water reservoir are also arranged in the insulated box.

Maintenance in the conventional down-flow-type ice-making machine described above is not easy because a worker has to reach into the insulated box to remove the pump and the level sensor, or has to disassemble the insulated box to remove them.

SUMMARY OF THE INVENTION

Accordingly, the present invention is intended to address the problems described above. An object of the present invention is to provide a down-flow-type ice-making machine wherein maintenance is facilitated and wherein a pump and a level sensor are easily detachable from a water reservoir.

To this end, according to one aspect of the present invention there is provided a down-flow-type ice-making machine comprising: an upwardly opening water reservoir arranged below an ice-making unit; a pump and a level sensor provided from an upper exterior opening of the water reservoir; a horizontal wall which forms a portion of a wall of an insulated box, the horizontal wall being provided at an upper portion of the water reservoir; a through-hole formed in the horizontal wall; and a bracket, on which the level sensor and the pump are mounted, the bracket being detachably mounted on the horizontal wall from the upper exterior of the insulated box. With this arrangement, the pump and the level sensor are easily detached from the water reservoir.

The down-flow-type ice-making machine may have a threadably detachable construction at only one end of the bracket and may also have an engagement means capable of inhibiting the rotation of the bracket at the other end. With this arrangement, although only one end of the bracket is fixed of the horizontal wall so that it may be easily detached, the bracket is inhibited from rotating.

The engagement means may include a projecting portion at one end of the bracket, and the insulated box may include a retaining portion to engage the projecting portion. With this arrangement, the rotation of the bracket is inhibited by a simple assembly mode such that the projecting portion of the bracket engages the retaining portion of the insulated box.

In the down-flow-type ice-making machine an inclined surface for drainage may be formed on the upper surface of the bracket. With this arrangement, even if condensation occurs on the upper surface of the bracket, the condensate is drained from the inclined surface and does not accumulate.

The pump may be mounted such that a motor unit of the pump is placed on the upper surface of the bracket, and the drive shaft of the motor unit provided so as to pass downwardly through the bracket with the height of the portion of the bracket mounting the motor unit being greater than the height of the peripheral region of the bracket. With this arrangement, any condensate on the bracket is prevented from falling into the water reservoir by passing through a gap between the drive shaft of the motor unit and the bracket without sealing the gap, so that the water remains hygienic.

DESCRIPTION OF THE PREFERRED EMBODIMENT

Figure 1:
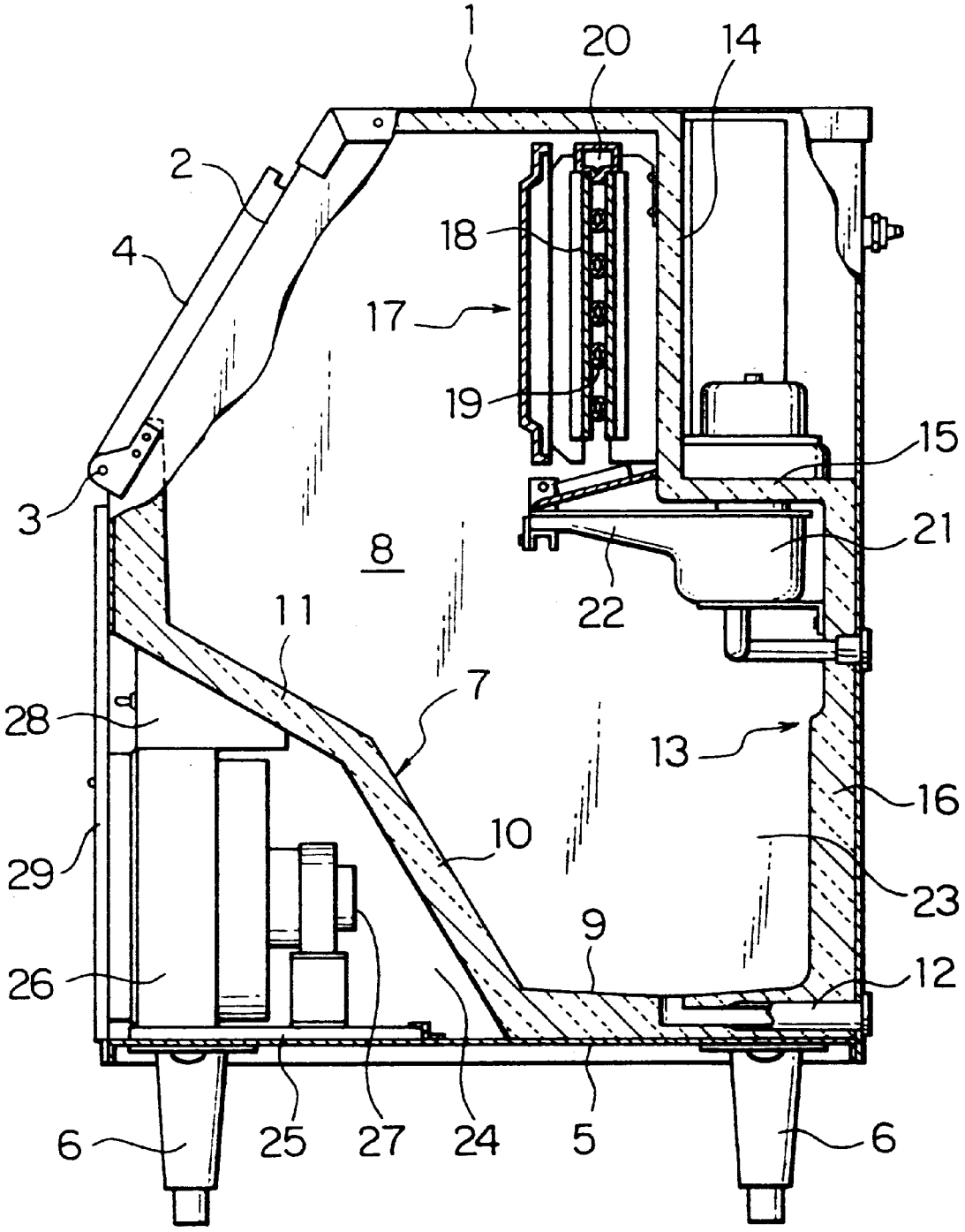
FIG. 1 is a sectional side view of a down-flow-type ice-making machine according to an embodiment of the present invention.

Referring to the figures, a preferred embodiment of the present invention will now be described as follows. FIG. 1 is a sectional side view of a down-flow-type ice-making machine according to an embodiment of the present invention. An outer casing 1 is a box made of stainless steel in which an opening 2 for taking out ice is formed at an upper front section thereof. The opening 2 for taking out ice can be opened and closed with a lid 4 which is rotatably mounted on the outer casing 1 by fittings 3. The outer casing 1 has a square base plate 5, and a plurality of supporting legs 6 provided under the base plate 5.

An insulated box 8, which is constructed of an insulating material 7, is formed in the outer casing 1. A bottom wall 9 of the insulated box 8 is positioned at the rear region of the base plate 5 of the outer casing 1. A first front wall 10 extends in an upwardly inclined manner from the front end portion of the bottom wall 9. Further, a second front wall 11 extends from the front end portion of the first front wall 10. An outfall for drainage 12 is provided at the bottom wall 9 of the insulated box 8.

A rear wall 13 of the insulated box 8 is formed by an upper vertical wall 14, a horizontal wall 15 which extends rearwardly from the bottom end of the upper vertical wall 14, and a lower vertical wall 16 which extends downwardly from the rear end of the horizontal wall 15. An ice-making unit 17 is provided in front of the upper vertical wall 14. The ice-making unit 17 is constructed of a pair of front and rear ice-making plates 18 and a cooling tube 19, that is, an evaporator, arranged between the plates. A sprinkler 20 is provided on the ice-making plates 18.

A water reservoir 21 having an upward opening is arranged under the horizontal wall 15 of the rear wall 13. A receptacle 22 of the water reservoir 21 extends toward a region under the ice-making unit 17 so as to receive water which drops down from the ice-making unit 17. A pump and a level sensor are mounted in the water reservoir, the details of which will be described later.

A lower region of the insulated box 8, that is, a region under the water reservoir 21, is an ice storage area 23 for storing ice produced by the ice-making unit 17. A machinery space 24 is provided in front of the ice storage area 23. A unit base 25 is arranged at the bottom of the machinery space 24, the unit base 25 being in the form of a plate that is mounted so as to be slidable in and out of the outer casing 1. A condenser 26, a fan motor 27 for the condenser, and a compressor (not shown) are arranged on the unit base 25. These members can be taken out from the machinery space 24 by pulling the unit base 25 out towards the front. Further, an electrical equipment box 28 is provided in an upper region of the machinery space 24. A front panel 29 having vent holes is detachably arranged in front of the machinery space 24.

Figure 2:
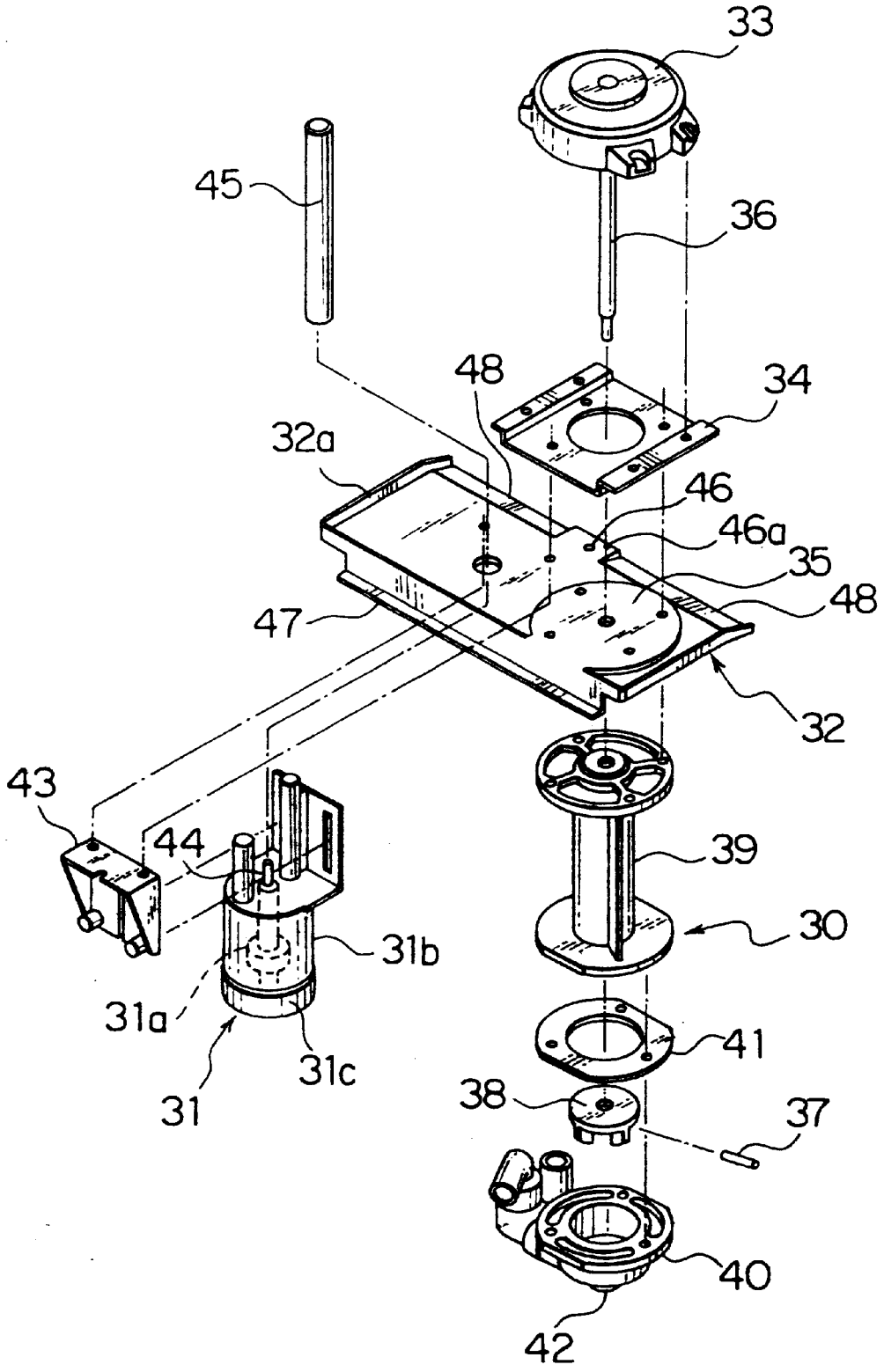
FIG. 2 is an assembly view showing an arrangement of a bracket, a pump, and a level sensor.

As shown in FIG. 2, a pump 30 and a level sensor 31 are mounted to a single bracket 32. A motor unit 33 of the pump 30 is mounted on the upper surface of the bracket 32 using a motor fixing member 34. The height of a mounting portion 35 for the motor unit 33 on the upper surface of the bracket 32 is greater than the height of the peripheral region of the upper surface of the bracket 32. A drive shaft 36 of the motor unit 33 passes downwardly through the bracket 32. An impeller 38 is fixed at an end portion of the drive shaft 36 using a pin 37. An upper surface of a cover 39 which covers the drive shaft 36 is fixed at the under surface of the bracket 32. A housing 40 for encasing the impeller 38 is mounted under the cover 39 through a gasket 41. A water inlet 42 is provided at a lower portion of the housing 40.

Additionally, with regard to the bracket 32, the level sensor 31 is mounted next to the pump 30 using a sensor-fixing member 43. The level sensor 31 is constructed of a float-type reed switch magnet 31*a* shown by dotted lines and a sensor casing 31*b* having a cylindrical protective wall portion 31*c* around the reed switch magnet 31*a* at a lower portion of the level sensor. When the pump 30 and the level sensor 31 are arranged in the water reservoir 21, the protective wall portion 31*c* of the sensor casing 31*b* prevents ripples of water, caused by the driving of the pump 30, from affecting the reed switch magnet 31*a*. A signal wire 44 of the level sensor 31 is protected by a vinyl tube 45 passed through the bracket 32. A tapped hole 46 is bored at the rear end of the bracket 32 for fixing the bracket 32. On the other hand, generally L-shaped projecting portion 47 extends downwardly in the longitudinal direction at the front end of the bracket 32. An inclined surface 48 for drainage that is downwardly and rearwardly inclined is formed at the rear end of the bracket 32 at both sides of a pedestal portion 46*a* of the tapped hole 46. Additionally, a lip portion 32*a* having a predetermined height is formed at the front, left, and right sides of the bracket 32, that is, at all sides except the rear.

Figure 3:
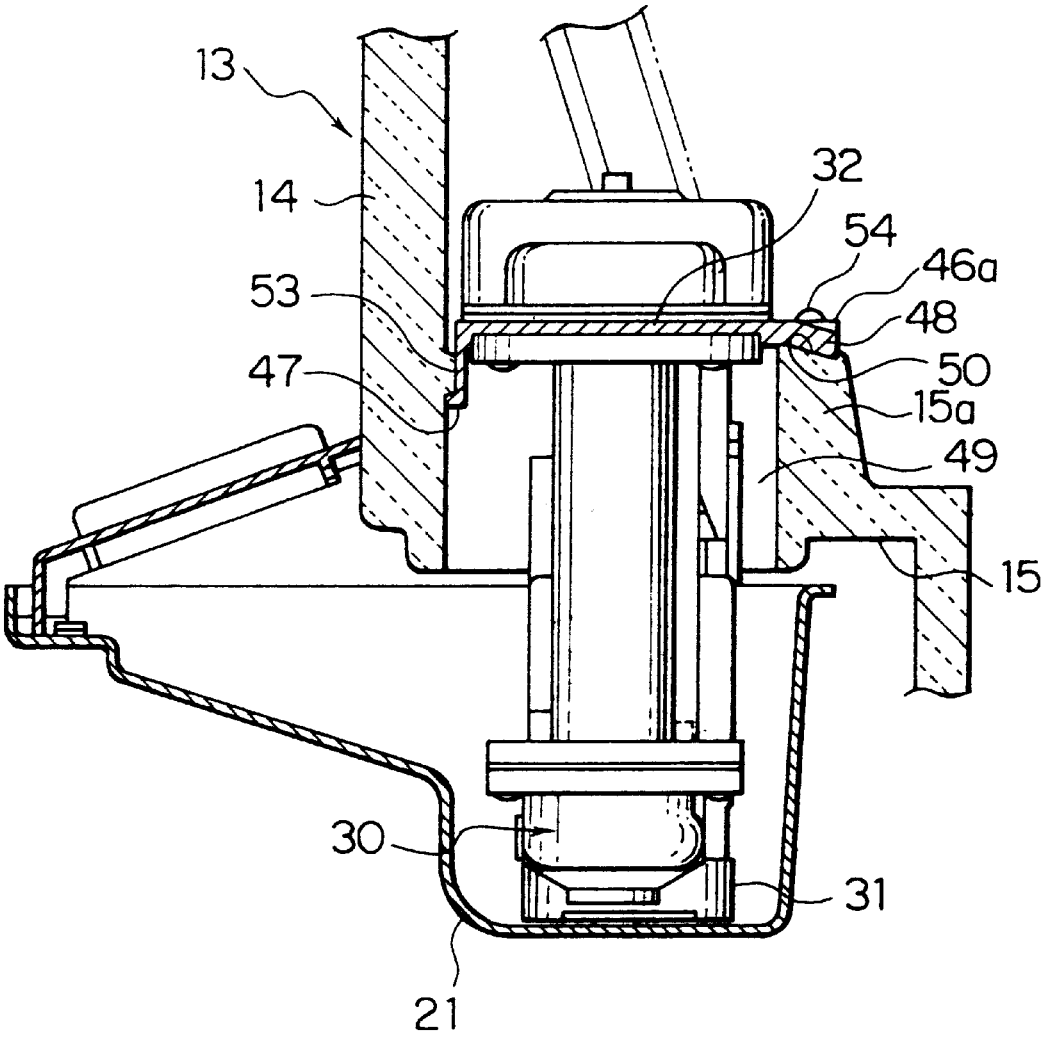
FIG. 3 is a cross-sectional view showing the proximity of a horizontal wall of an insulated box.
Figure 4:
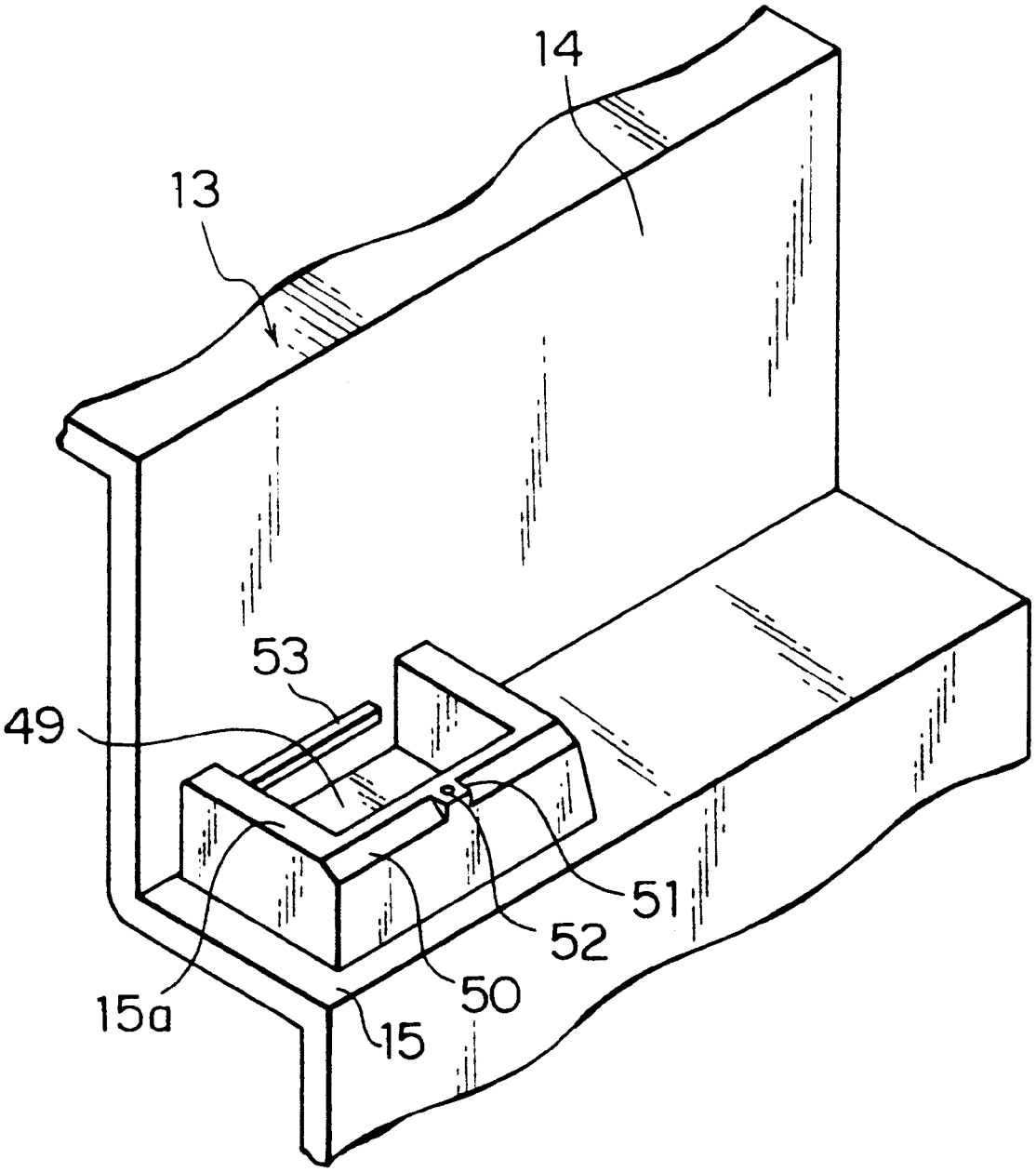
FIG. 4 is a rear perspective view of an upper vertical wall and the horizontal wall of the insulated box.

As shown in FIG. 3, a through-hole 49 is provided in the horizontal wall 15 which forms part of the rear wall 13 of the insulated box 8, the through-hole 49 being positioned above the water reservoir 21. The bracket 32 is placed on a portion 15*a* that forms the through-hole 49, the pump 30 and the level sensor 31 being mounted on the bracket. Further, the upper-rear portion of the portion 15*a* is formed so as to fit the configuration of the rear end of the bracket 32. In other words, as shown in FIG. 4, with regard to the upper surface of the portion 15*a*, a portion for mounting the inclined surface 48 of the bracket 32 is formed as an inclined region 50 having the same slope as the inclined surface 48, a portion for mounting the pedestal portion 46*a* of the tapped hole 46 is formed as a horizontal region 51, and a tapped hole 52 is provided on the horizontal region 51. A protruding portion (retaining portion) 53 which extends horizontally is provided in the through-hole 49 on the rear surface of the upper vertical wall 14. With regard to the bracket 32, as shown in FIG. 3, the L-shaped projecting portion 47 engages under the protruding portion 53. The bracket 32 is detachably fixed on the portion 15*a* of the through-hole 49 by a screw 54, so that the pump 30 and the level sensor 31 are mounted through the through-hole 49 at a predetermined position in the water reservoir 21.

With regard to the down-flow-type ice-making machine described above, an overflow pipe (not shown) is provided in the water reservoir 21, so that the ice-making process starts when the water level rises to an upper limit determined by the overflow pipe. The water in the water reservoir 21 is transferred to the sprinkler 20 by the pump 30, and sprayed on the ice-making plates 18. The water is cooled by the cooling tube 19 as it flows downwardly through the ice-making plates 18 and gradually freezes. Further, water which does not freeze falls into the receptacle 22 in the water reservoir 21 from the lower ends of the ice-making plates 18. Thus, water that freezes on the ice-making plates 18 is not recovered into the water reservoir 21 during the circulation of the water, so that the water level in the water reservoir 21 gradually becomes lower. When the water level reaches a lower limit, the pump 30 stops and the ice-making process ends. The ice which freezes on the ice-making plates 18 is separated from the ice-making plates 18 by means of hot gas which flows through the cooling tube 19.

When the pump 30 and the level sensor 31 are removed from the water reservoir 21 for maintenance, the screw 54 positioned at the rear end of the bracket 32 is loosened and the pump 30 and the level sensor 31 are raised together with the bracket 32 from the exterior of the insulated box 8, that is, from the portion above the horizontal wall 15. Conversely, when the pump 30 and the level sensor 31 are mounted at the predetermined position in the water reservoir 21, they can be mounted from the portion above the horizontal wall 15. Additionally, when the bracket 32 on which the pump 30 and the level sensor 31 are fixed is mounted on the horizontal wall 15, the horizontal positioning of the bracket with regard to the portion 15*a* of the horizontal wall 15 can be easily conducted, because, due to the configuration of the rear end of the bracket 32 and the rear region of the upper surface of the portion 15*a* of the horizontal wall 15, the horizontal region 51 of the portion 15*a* of the horizontal wall 15 fits the region between the inclined surfaces 48 of the bracket 32.

The bracket 32 is fixed at a predetermined position with the screw 54 so as to be easily detachable, and the L-shaped projecting portion 47 is formed in the longitudinal direction, so that rotation of the bracket 32 around the screw 54 is inhibited.

Furthermore, condensation may occur on the upper surface of the bracket 32 because of the cold air around the lower portion of the horizontal wall 15. The resultant condensate drains from the inclined surface 48 at the rear end of the bracket 32 without spilling from the front, left, and right sides of the bracket 32 due to the lip portion 32*a*. Since the height of the mounting portion 35 for the motor unit 33 is greater than the height of the peripheral region of the bracket 32, the condensate on the bracket 32 is prevented from falling into the water reservoir 21 by passing through a gap between the through-hole and the drive shaft 36 without sealing the gap between the drive shaft 36 and a hole on the bracket 32.

Since mounting holes, a through-hole for the signal wire 44, and a through-hole for the drive shaft for the motor unit 33 are passed though the bracket 32, the closure of the through-hole 49 with the mounting of the bracket 32 separates a component compartment above the horizontal wall 15 from the insulating compartment below the horizontal wall 15. Additionally, as described above, no condensate enters the insulating compartment, so the water remains hygienic.

What is claimed is:

1. A down-flow-type ice-making machine comprising:

an upwardly opening water reservoir arranged below an ice-making unit;

a pump and a level sensor provided from above said water reservoir;

a horizontal wall which forms a part of a wall of an insulated box, said horizontal wall being formed at an upper portion of said water reservoir;

a through-hole formed in said horizontal wall; and a bracket, on which said level sensor and said pump are mounted, said bracket being detachably mounted on said horizontal wall from the upper exterior of said insulated box.

2. A down-flow-type ice-making machine according to claim 1, wherein only one end of said bracket has a threadably detachable construction and the other end has an engagement means capable of inhibiting the rotation of said bracket.

3. A down-flow-type ice-making machine according to claim 2, wherein said engagement means comprises a projecting portion at one end of said bracket, and said insulated box comprises a retaining portion to engage said projecting portion.

4. A down-flow-type ice-making machine according to claims 1, wherein an inclined surface for drainage is formed on an upper surface of said bracket.

5. A down-flow-type ice-making machine according to claims 1, wherein said pump is mounted such that a motor unit of said pump is mounted on the upper surface of said bracket, and a drive shaft of said motor unit is provided so as to pass downwardly through said bracket; the height of a mounting portion for said motor unit on said bracket being greater than the height of the peripheral region of said bracket.

* * * * *